US012631023B2

(12) United States Patent
Harada et al.

(10) Patent No.: US 12,631,023 B2
(45) Date of Patent: May 19, 2026

(54) ARCHITECTURAL STRUCTURE AND WALL MEMBER FOR THE SAME

(71) Applicant: LUMICA CORPORATION, Fukuoka (JP)

(72) Inventors: Shiro Harada, Fukuoka (JP); Kazuki Nakamura, Fukuoka (JP)

(73) Assignee: LUMICA CORPORATION, Fukuoka (JP)

( * ) Notice: Subject to any disclaimer, the term of this patent is extended or adjusted under 35 U.S.C. 154(b) by 171 days.

(21) Appl. No.: 18/414,653

(22) Filed: Jan. 17, 2024

(65) Prior Publication Data

US 2024/0240455 A1 Jul. 18, 2024

(30) Foreign Application Priority Data

Jan. 18, 2023 (JP) ..... 2023-006085

(51) Int. Cl.
*E04B 2/70* (2006.01)

(52) U.S. Cl.
CPC ..... *E04B 2/702* (2013.01)

(58) Field of Classification Search
CPC . E04B 2/70; E04B 2/701; E04B 2/702; E04B 2/704
USPC ..... 52/233
See application file for complete search history.

(56) References Cited

U.S. PATENT DOCUMENTS

| | | | | | |
|---|---|---|---|---|---|
| 1,059,794 | A * | 4/1913 | Webster | E04B 1/24 | 52/261 |
| 4,905,409 | A * | 3/1990 | Cole | A01G 9/28 | 47/33 |
| 6,079,910 | A * | 6/2000 | Marianski | E21D 15/48 | 52/233 |

FOREIGN PATENT DOCUMENTS

| | | | | |
|---|---|---|---|---|
| CA | 2246938 | A1 * | 3/2000 | E04B 2/702 |
| CH | 270008 | A * | 8/1950 | E04B 2/702 |
| EP | 0312482 | A1 * | 4/1989 | E04B 2/704 |
| EP | 2944733 | A1 * | 11/2015 | E04B 2/70 |
| GB | 2392175 | A * | 2/2004 | A01G 9/28 |
| JP | S52-148743 | | 11/1977 | |
| JP | H08-239923 | | 9/1996 | |
| JP | 2000-248660 | | 9/2000 | |
| JP | 2005-348680 | A | 12/2005 | |
| JP | 2020-162436 | | 10/2020 | |

* cited by examiner

*Primary Examiner* — Christine T Cajilig
(74) *Attorney, Agent, or Firm* — Nakanishi IP Associates, LLC

(57) ABSTRACT

A wall member includes: a lower member in a shape of a plate including a first rear face, a first side face, and a first angle between the first rear face and the first side face being a first acute angle; an upper member in a shape of a plate to be combined with the lower member, the upper member including a second rear face, a second side face opposed to the first side face of the lower member, and a second angle between the second rear face and the second side face being a second acute angle; a fitting portion (recess and projection) enabling a lower face of the lower member and an upper face of the upper member to be fitted with each other; and a hole through which an axial member is arranged in a vertical direction.

4 Claims, 7 Drawing Sheets

ARCHITECTURAL STRUCTURE AND WALL MEMBER FOR THE SAME

BACKGROUND OF THE INVENTION

1. Field of the Invention

The present invention relates to an architectural structure and a wall member for constructing the architectural structure.

2. Description of the Related Art

Most architectural structures constructed by means of lumber have basically a shape of a rectangle and/or the combination thereof in a plan view. This is because portions formed at right angles which can be easily machined when machining the lumber in addition to joint portions or the like are frequently used. This is similar to the log houses utilizing logs.

Recently, enabling to reduce occasions of contact for excellent ventilation and various fashion such as a sauna boom have combined to increase demand for outdoor leisure and also the diversity of the same. Since it is easily affected in outdoors because of weather conditions such as wind and rain, highly convenient and easy architectural structure such as a hut are highly required so as to set up usage conditions of various facilities.

On the other hand, with respect to a building having a shape of a polygon at least of a pentagon in a plan view, it is difficult to machine the same, since there may be a basic member structure other than the right angle and combination of the angles becomes so complicated. Due to this problem, it may be considerable to build thereof while using a column machining portion wherein a plurality of wall members can be attached thereto.

Reference 1 (Japanese Patent Application Laid-open No. H08-239923) discloses wall surface unit members for a log house built by: laminating lumber members to assemble wall faces; and adding roof members and floor members. It has a feature wherein lumber members produced as wood waste when demolishing an old house are used as raw material. The old lumber members are reformed to be unit members with predetermined dimension and shape of three through twenty kinds and having the longest dimension of 28 through 100 [cm]. The unit members are laminated and fixed by means of fitting mechanism wherein adjacent unit members are engaged with each other so as to be firmly assembled with high precision without a fixing tool such as a nail or the like.

Reference 2 (Japanese Patent Application Laid-open No. 2020-162436) discloses a structure for breeding fishes and plant cultivation, the structure including: a water tub in a shape of a substantial ring in a plan view, and a planter disposed on a shelf arranged at a upper portion of the water tub.

LIST OF CITED REFERENCES

Reference 1: Japanese Patent Application Laid-open No. H08-239923; and

Reference 2: Japanese Patent Application Laid-open No. 2020-162436.

As disclosed in Reference 1, there is a known wall unit that can be assembled for a log house, and the structure thereof is suitable for a structure in a shape of a rectangular. However, the structure offers less shape freedom. As disclosed in Reference 2, in order to form a polygon, it may be effective to form columns, beams, and walls disposed therebetween with different members in some cases. In these cases, it may be assumed to use the respective long members. The bigger the members become, the heavier they become naturally to reduce workability upon transferring and assembling thereof. It may be more needed to prepare members in accordance with the respective design, thereby easily decreasing option upon construction thereof.

On the other hand, in a case of architectural structure of a size of a so-called hut or the like, it may be better to easily construct the same freely in accordance with needs of the customer and in various places. Accordingly, it may be also better to enable to construct the same with members that are easily transferred, offer combination freedom, and are easily assembled. Upon assuming members that offer the combination freedom and that have height wherein the members are easily transferred, the design of the members becomes very difficult unfortunately. Especially, it is so difficult to design members for assembling architectural structures of polygons at ease.

In view of the above, an object of the present invention is to provide an architectural structure including a wall structure enabling to easily construct architectural structures in various shapes, and a wall member for the same.

OBJECTS AND SUMMARY OF THE INVENTION

The inventors of the present invention have been eagerly studied resolution for the above problems, and finally have found that the inventions mentioned-below match the object to achieve the present invention. That is, the present invention relates to the followings.

A first aspect of the present invention provides: an architectural structure to be constructed by means of a plurality wall members, each of which comprising:

a lower member in a shape of a plate including a first rear face, a first side face, and a first angle between the first rear face and the first side face being a first acute angle;

an upper member in a shape of a plate to be combined with the lower member, the upper member including a second rear face, a second side face opposed to the first side face of the lower member, and a second angle between the second rear face and the second side face being a second acute angle;

the architectural structure, comprising:

at least a part of a wall including a combined portion wherein: one of two adjacent wall members each of which is one of the plurality of wall members is combined as a first wall member; and the other of the two adjacent wall members is combined as a second wall member, the combined portion includes arrangement wherein:

the first rear face of the lower member of the first wall member contacts with the first side face of the lower member of the second wall member at a side of the second side face of the first wall member; and the second side face of the upper member of the first wall member contacts with the second rear face of the second wall member, the wall includes a wall construction portion wherein the combined portion is repeatedly arranged.

A second aspect of the present invention provides, in addition to the first aspect, wherein:

each of the plurality of wall members includes:

a fitting portion having a shape enabling a lower face of the lower member and an upper face of the upper member to be fitted with each other; and a hole through which an axial member is arranged in a vertical direction;

wherein the architectural structure comprises at least two stages of the wall construction portions are provided in the vertical direction by:

inserting a long axial member into the hole of each of the plurality of wall members; and fitting the fitting portion of the upper member arranged in the vertical direction with the lower wall member and a corresponding fitting portion of the lower member arranged with the upper wall member.

A third aspect of the present invention provides, in addition to at least one of the first and the second aspects, wherein the architectural structure has a shape of a polygon, at least of a pentagon in a plan view.

A fourth aspect of the present invention provides, in addition to the third aspect, wherein the architectural structure has a shape of a substantial regular polygon in the plan view.

A fifth aspect of the present invention provides a wall member, comprising:

a lower member in a shape of a plate including a first rear face, a first side face, and a first angle between the first rear face and the first side face being a first acute angle; and an upper member in a shape of a plate to be combined with the lower member, the upper member including a second rear face, a second side face opposed to the first side face of the lower member, and a second angle between the second rear face and the second side face being a second acute angle.

A sixth aspect of the present invention provides, in addition to the fifth aspect, further comprising at least one of:

a fitting portion enabling a lower face of the lower member and an upper face of the upper member to be fitted with each other; and a hole through which an axial member is arranged in a vertical direction. Effect of Invention According to the present invention, it is able to easily build architectural structures in various shapes.

DETAILED DESCRIPTION OF THE PREFERRED EMBODIMENTS

Figure 1:
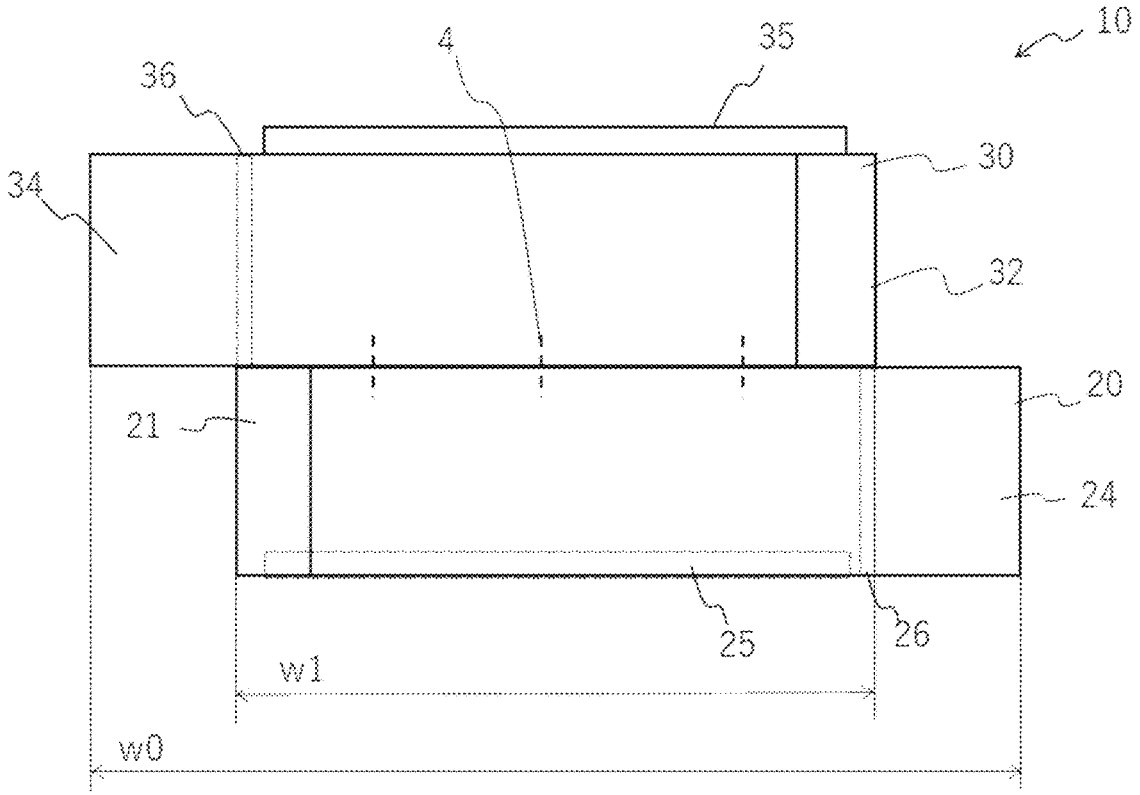
FIG. 1 shows an outline of a wall member in Embodiment 1 according to the present invention.

Referring to the drawings, Embodiments according to the present invention will now be explained more concretely. Explanation of requirements as described below is related to mere Embodiments (representative examples) of the present invention. The present invention is not limited thereto without departing from the broad inventive concepts of the present invention. When expression with respect to a numeral range (for example, from "x" to "y") is used in the specification, it is meant that the range may include a greater number than "y" and/or a less number than "x."

Wall Member of the Present Invention

Each of the wall members of the present invention includes: a lower member in a shape of a plate including a first rear face, a first side face, and a first angle θ1 between the first rear face and the first side face being a first acute angle; an upper member in a shape of a plate to be combined with the lower member, the upper member including a second rear face, a second side face opposed to the first side face of the lower member, and a second angle θ2 between the second rear face and the second side face being a second acute angle.

It is preferable that each of the wall members further includes at least one of: a fitting portion enabling a lower face of the lower member and an upper face of the upper member to be fitted with each other; and a hole through which an axial member is arranged in a vertical direction.

Architectural Structure of the Present Invention

The architectural structure of the present invention is an architectural structure constructed by means of a plurality wall members, the architectural structure, comprising: at least a part of a wall including a combined portion wherein: one of two adjacent wall members each of which is one of the plurality of wall members is combined as a first wall member; and the other of the two adjacent wall members is combined as a second wall member, the combined portion includes arrangement wherein: the first rear face of the lower member of the first wall member contacts with the first side face of the lower member of the second wall member at a side of the second side face of the first wall member; and the second side face of the upper member of the first wall member contacts with the second rear face of the second wall member, the wall includes a wall construction portion wherein the combined portion is repeatedly arranged.

Herein, the architectural structure of the present invention may be obtained by means of the wall members according to the present invention. In other words, it is considerable that the present invention provides a manufacture method of the wall members of the present invention and/or the architectural structure of the present invention. The respective matters with respect to the members, the ideas, the structures, the methods, and so on in accordance with the present invention may be used in a mutual relationship.

The inventors of the present invention have studied how to easily construct architectural structures in a shape of a polygon (for example, a regular octagon, a regular dodecagon, or the like.) in a plan view. It is preferable to select structure members each having a range with respect to weight and size to be easily transferred with high workability in order to respond to various demands. In this context, the inventors have experienced the great importance of the design with respect to the wall members that are stacked upwardly to be appropriately positioned.

In order to form the polygon by means of the wall members, a structure for tilting a corner portion at an angle other than the right angle is needed naturally. Even if helping the positioning thereof with bolts or the like, the structure tends to zigzag in the vertical direction and/or to tilt to one side too much in some cases. On the other hand, it is not practical to manufacture a unit by combining a plurality of stages, since corner portions at various angles of the plate members require so complicated machining. As results of trials and errors as mentioned above, the inventors have devised the wall members and the architectural structure using the same with which various shapes can be constructed even if a builder has little experience with respect to construction.

Wall Member 10

Figure 2:
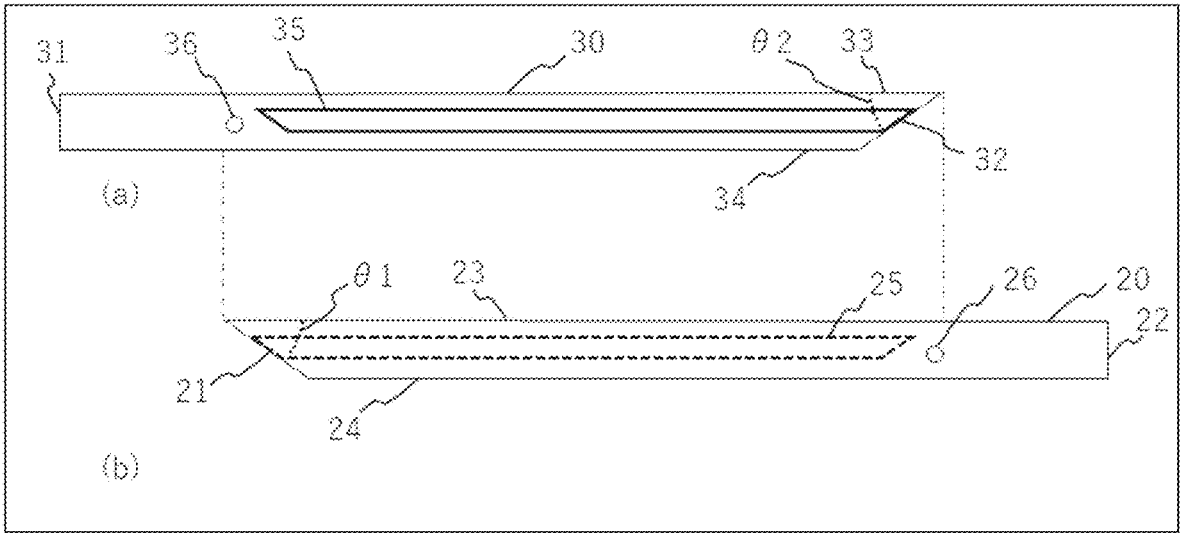
FIG. 2 shows an outline of members constituting the wall member according to the present invention.
Figure 3:
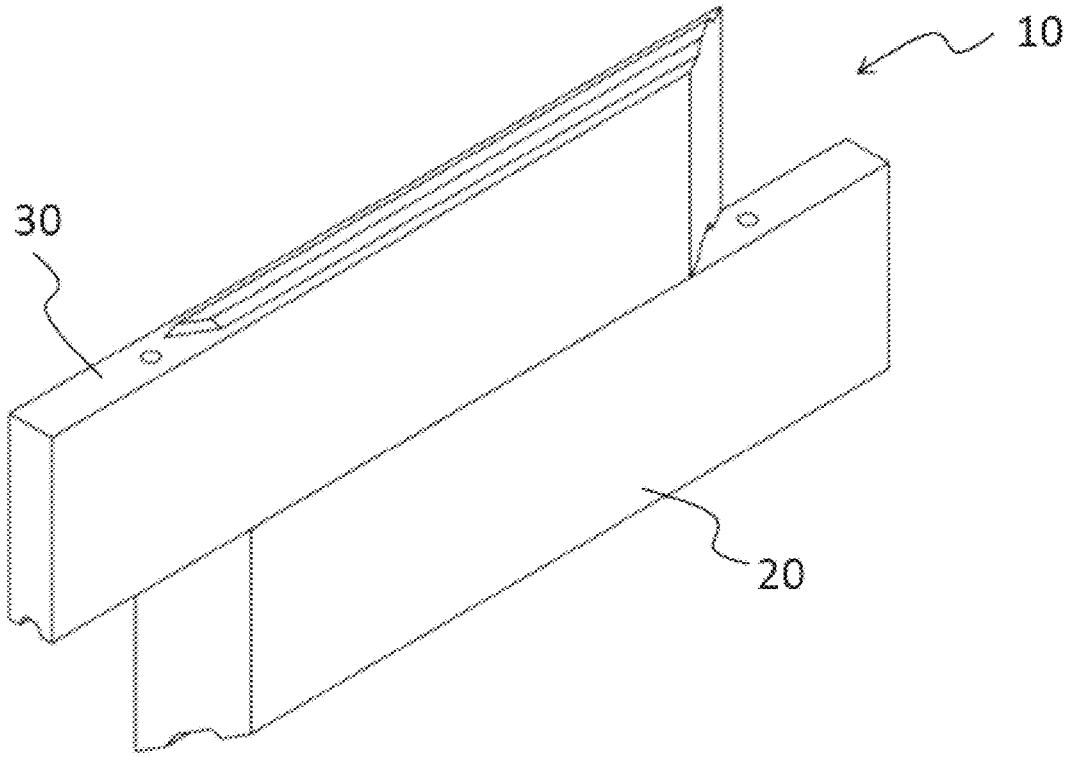
FIG. 3 shows an outline of the wall member in Embodiment 1 according to the present invention.

FIG. 1, FIG. 2, and FIG. 3 show an outline of a wall member in Embodiment 1 according to the present invention, FIG. 2 shows a front view of the wall member 10 shown in FIG. 1, and FIG. 3 shows a perspective view of the wall member 10.

The wall member 10 is formed by combining the lower member 20 and the upper member 30 with the joining member 4. A part of the wall according to the architectural structure can be constructed by stacking the wall members 10, 10 together.

The rear faces 23, 33 become inside faces when the architectural structure has been constructed with the wall members 10. The front faces 24, 34 become outside faces when the architectural structure has been constructed with the wall members 10. When shapes of the first side face 21 and the second side face 32 of the wall member 10 are utilized to be combined with each other, the respective front faces correspond to the outer faces and the respective rear faces correspond to the inner faces in this way.

Lower Member 20

The lower member 20 is a member in a shape of a plate, the lower member 20 being positioned below in a vertical direction when the wall members 10 are used as a wall. The lower member 20 includes the first rear face 23, the first side face 21, and the first angle θ1 of an acute angle between the rear face 23 and the first side face 21. A lower face of the lower member 20 includes: the recess 25 capable of fitting with the projection 35 of the lower member 3; and the hole 26 through which an axial member is arranged in a vertical (up-down) direction when the architectural structure has been constructed.

Upper Member 30

The upper member 30 is a member in a shape of a plate, the upper member 30 being positioned above in the vertical direction when the wall members 10 are used as the wall. The upper member 30 includes the second rear face 33, the second side face 32, and the second angle θ2 of an acute angle between the rear face 33 and the second side face 32. An upper face of the upper member 30 includes: the projection 35 capable of fitting with the recess 25 of the lower member 20; and the hole 36 through which an axial member is arranged in a vertical (up-down) direction when the architectural structure has been constructed.

Fitting Portion (Recess 25, Projection 35)

Figure 4:
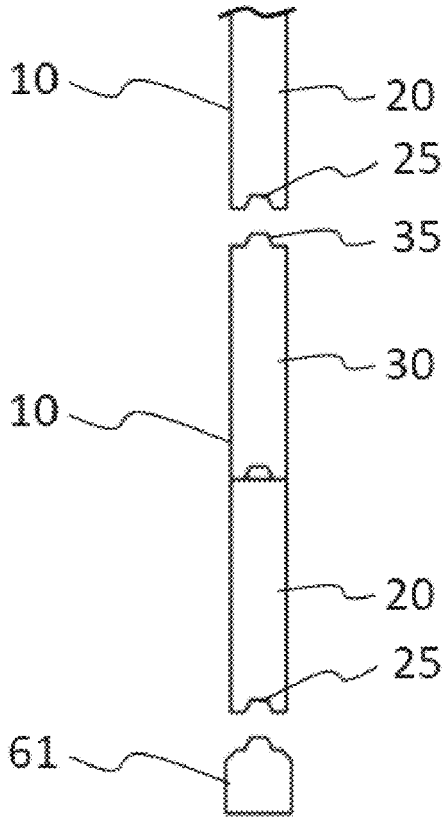
FIG. 4 shows a flow upon constructing an architectural structure according to the present invention.

FIG. 4 shows a flow upon constructing an architectural structure according to the present invention. By fitting the projection 35 of the below stacked upper member 30 with the recess 25 of another above stacked wall member 10, the wall members 10 can be stacked upwardly. With respect to the recess 25 of the lowest stage of the wall members 10, it is preferable to provide a shape corresponding to the projection 35 with the sill member 61 in a manner such that the wall members 10 can be stacked on the sill member 61. It is sufficient that the recess 25 and the projection 35 work as the fitting portion when they are arranged in a vertical direction. The recess 25 and the projection 35 shown in FIG. 1 may be reversed. Alternatively, another fit-able structure may be employed instead thereof.

In this way, it is possible to build a wall construction portion including two or more stages of the wall members by fitting the fitting portion of the upper member 30 arranged in a vertical direction with the lower wall member 10 and the corresponding fitting portion of the lower member 20 arranged with the upper wall member 10. Furthermore, it is also possible to stack the members upwardly while performing guiding, positioning, reinforcement, and so on by inserting a long axis member into the hole of the wall member 10.

Since the lower member 20 and the upper member 30 have the respective tilted portions and the respective portions sticking out from each other, the wall member 10 must have so complicated shape. In view of this point, it is preferable that the lower member 20 and the upper member 30 are processed independently with different members as shown in FIG. 2. After that, the lower member 20 and the upper member 30 may be combined with each other.

Upon combing the lower member 20 and the upper member 30 with each other, the rear face 23 and the rear face 33 should be combined while facing with each other. At this stage, the combination may be performed by an arbitrary means capable of combining the lower member 20 and the upper member 30, such as bonding with adhesive, screw fastening, doweling, u-shaped nails, upper and lower mating members, or the like. In this example, doweling by means of the combination member 4 is performed.

Considering the first length of a sticking portion leftward (in FIG. 2) from the first side face 21 of the lower member 20, the first side face 31 of the upper member 30 is arranged and combined in a manner such that the first side face 31 exceeds the first side face 21 in the width direction. The rear face 33 of the sticking portion toward the first side face 31 of this upper member 30 is a face that contacts with the second side face 32 of the upper member 30 when making the combination portion together with the wall member 10 (See, FIG. 6(*c*).).

Considering the second length of a sticking portion rightward (in FIG. 2) from the second side face 32 of the upper member 30, the second side face 22 of the lower member 20 is arranged and combined in a manner such that the second side face 22 exceeds the second side face 32 in the width direction. The rear face 23 of the sticking portion toward the second side face 22 of this lower member 20 is a face that contacts with the first side face 21 of the lower member 10 when making the combination portion together with the wall member 10 (See, FIG. 6(*c*).).

First Angle θ1, Second Angle θ2

The first angle θ1 is an angle between the rear face 23 of the lower member 20 and the first side face 21 of the lower member 20. And, the second angle θ2 is an angle between the rear face 33 of the upper member 30 and the second side face 32, which is opposed to the first side face 21 of the lower member 20, of the upper member 30.

Since both the first angle θ1 and the second angle θ2 are acute angles, adjacent wall members can be combined to be arranged perimetrically, thereby enabling to form a polygon at least of a pentagon. The first angle θ1 and the second angle θ2 can be designed in accordance with concrete design for an architectural structure. The more vertexes the polygon has, the more dome-shaped and/or tube-shaped it looks like, and the stronger it is expected to become against wind or the like. In this context, it is preferable that the first angle θ1 and the second angle θ2 are acuter in order to increase the vertexes of the polygon. It is preferable that the first angle θ1 and the second angle θ2 are more acute, for example, not greater than 75 degrees, 70 degrees, 65 degrees, 60 degrees, or the like.

It is preferable that the first angle θ1 and the second angle θ2 of the adjacent wall members contacting with each other are identical. If not identical, a gap between the rear face and the side face of the adjacent wall members is easily formed. When the formed gap can be allowed, let the gap be on purpose in terms of ventilation. Otherwise, if the formed gap is surplus, a member for filling the gap up may be disposed.

When the sum of angles of vertexes of the architectural structure in a plan view is 360 degrees, the architectural structure is arranged perimetrically. In this context, upon forming a regular polygon, design may be performed based on an angle of 72 (=360/5) degrees. Similar to this, if it is a regular hexagon then design may be performed based on an angle of 45 (=360/8) degrees, if it is a regular decagon then design may be performed based on an angle of 36 (=360/10) degrees, if it is a regular dodecagon then design may be performed based on an angle of 30 (=360/12) degrees. Needless to say, a form other than a regular polygon may be used. Since a door used as an entrance may be adjusted by means of members processed not based on the first angle θ1 and the second angle θ2. The above-mentioned angles may be adapted as a mere criterion, some degree (such as, negative 10% through positive 10%, negative 5% through positive 5%, negative 2% through positive 2%, or the like.) of error is acceptable.

It is preferable that the first angle θ1 and the second angle θ2 are identical regarding design for a regular polygon. This relationship enables to build combination portions and wall construction portions by means of common members, thereby reducing kinds of members for manufacturing an architectural structure.

Size

Sizes of the whole wall member 10 and the respective portion thereof can be appropriately set up in accordance with a size and/or usage of an architectural structure constructed there-with and a portion wherein the wall member 10 is used, or the like. When used for a size of a hut in a vertical direction and the wall members are used for only a base within the height of near a waist of a human, a number of stages of the wall members 10 may be almost two through five. When stacking up the wall members 10 to near the ceiling and the height may exceed a head of a human, a number of stages of the wall members 10 may be almost four through ten. Width of the wall member may be appropriately set up based on a number of angles, a size of the whole architectural structure, or the like. Thickness of the wall member 10 may be set up based on a kind and strength of wall member, or the like.

In a case where it is assumed to use the wall members 10 for constructing an architectural structure in a size of a hut or the like with angles such as in a shape of regular dodecagon, the following range may be set up for example.

With respect to width of the wall members 10, width W1 from an end of the first side face 21 to an end of the second side face 32 is width of an inner edge of the architectural structure. In addition, the whole width w0 (See, FIG. 1.) is set up considering transportability and workability when combining the same with an adjacent wall member. The width w0 may be set up to be about 30 [cm] through 2 [m], or 50 [cm] through 1.5 [m]. The width w0 may be set up shorter than the width w0 by 10 [cm] through 50 [cm], 20 [cm] through 40 [cm], or the like.

It is preferable to stack up a plurality of stages when constructing a wall by means of the wall member 10 considering transportability and workability of the respective members. In this context, the whole height of the wall member 10 is preferably to be almost 20 [cm] through 80 [cm], and more preferably to be almost 30 [cm] through 50 [cm]. The upper member and the lower member may have the same level of the height, or there may be the height difference there-between.

Thickness of the wall members 10 can be appropriately set up considering strength and material of the wall. For example, it may be 1 [cm] through 10 [cm], 2 [cm] through 5 [cm], or the like. The thicker it is, the higher strength can be obtained. However, too much thickness makes it difficult to machine, transfer, assemble, and stack up thereof in some cases.

It is preferable to design the wall member 10 to have weight wherein a worker can easily assemble thereof. The wall member 10 can be manufactured to have weight not greater than 15 [kg], 10 [kg], 8 [kg], or the like.

The wall member can be stacked upwardly in a vertical direction by inserting an axis member into a hole. There may be a case where the wall member may shrink with long term use. At this stage, it is possible to retighten the member in the vertical direction of the wall member with a bolt attached to the ceiling side of the axis member, thereby performing adjustment of the whole height of the wall in accordance with the shrink of the wall member. In this way, the ceiling is re-built to prevent from occurring gaps caused by the shrink.

Material

Various kinds of materials used for architectural material can be used as material of the wall members 10, especially wooden material, resin material, or the like. It is particularly preferable to use the wooden material as the main material. Since the architectural structure of the present invention can be designed to be like a log house, it may be manufacture based on logs, or the like. This wooden material includes the main material of wood, and may utilize members other than wood, such as nails, screws, (adhesive, paint) members used for a general architectural structure to improve connection, design, and durability thereof.

Figure 5:
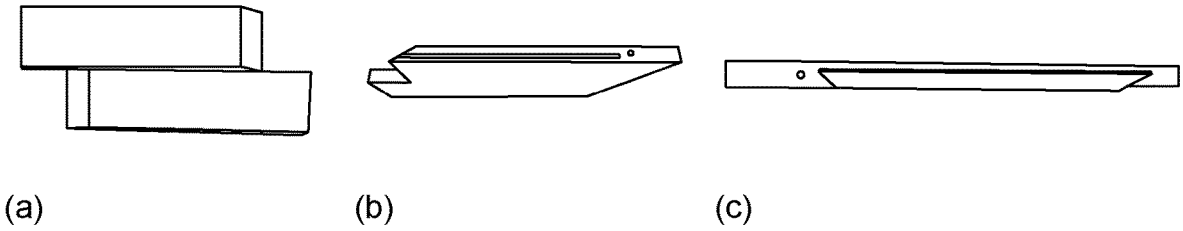
FIG. 5 shows images regarding the wall members in Embodiment 1 according to the present invention.

FIG. 5 shows images regarding a manufacturing example of the wall members according to the present invention, FIG. 5(*a*) shows a front view from the side of a front face, FIG. 5(*b*) shows a perspective view from the side of a rear face, and FIG. 5(*c*) shows a plan view. These wall members are manufactured by means of lumber, and have the whole height of about 370 [mm], the whole width w0 of about 1070 [mm], the distance w1 from an end of the first side face to an end of the second side face of 940 [mm], and thickness of about 45 [mm]. The respective height of the lower member and the upper member is about 185 [mm]. Each of the first angle θ1 and the second angle θ2 is 30 degrees. These wall members are designed to be used for the wall in a shape of a regular dodecagon.

Architectural Structure in Polygon Shape

The Architectural structure may be a polygon structure at least of a pentagon. It is preferable to design this polygon so that it has clean inner angles not less than 90 degrees and less than 180 degrees. In view from outside, this polygon does not include a big plane to look like a so-called dome and/or a cylinder that parries a load of winds in various directions.

The number of vertexes of the architectural structure in a plan view may be roughly almost 5 through 36, and more preferably almost 6 through 20. The architectural structure may have a shape of a regular polygon substantially in the plan view. If so, there are more sides that mutual members can be used as wall members thereof, thereby making preparation thereof, loading and transferring thereof, and assembling thereof more easily. Furthermore, since the regular polygon has the same shape from various directions, the load of the same can be also distributed at ease.

Size

The whole shape of the architectural structure may be appropriately set up in accordance with usage thereof or the like. In a design where the wall members according to the present invention are widely used for sides other than a side of the door in a circumferential direction, it is preferable that the structure has a size of a hut, which can be easily built without providing a column, or the like, and can be assembled flexibly according to demands. In this context, a size corresponding to width, depth, and diameter may be roughly almost 1.5 [m] through 10 [m], and more preferably almost 2 [m] through 8 [m]. The height thereof may be roughly almost 1.5 [m] through 4 [m], and more preferably almost 2 [m] through 3 [m].

Figure 6:
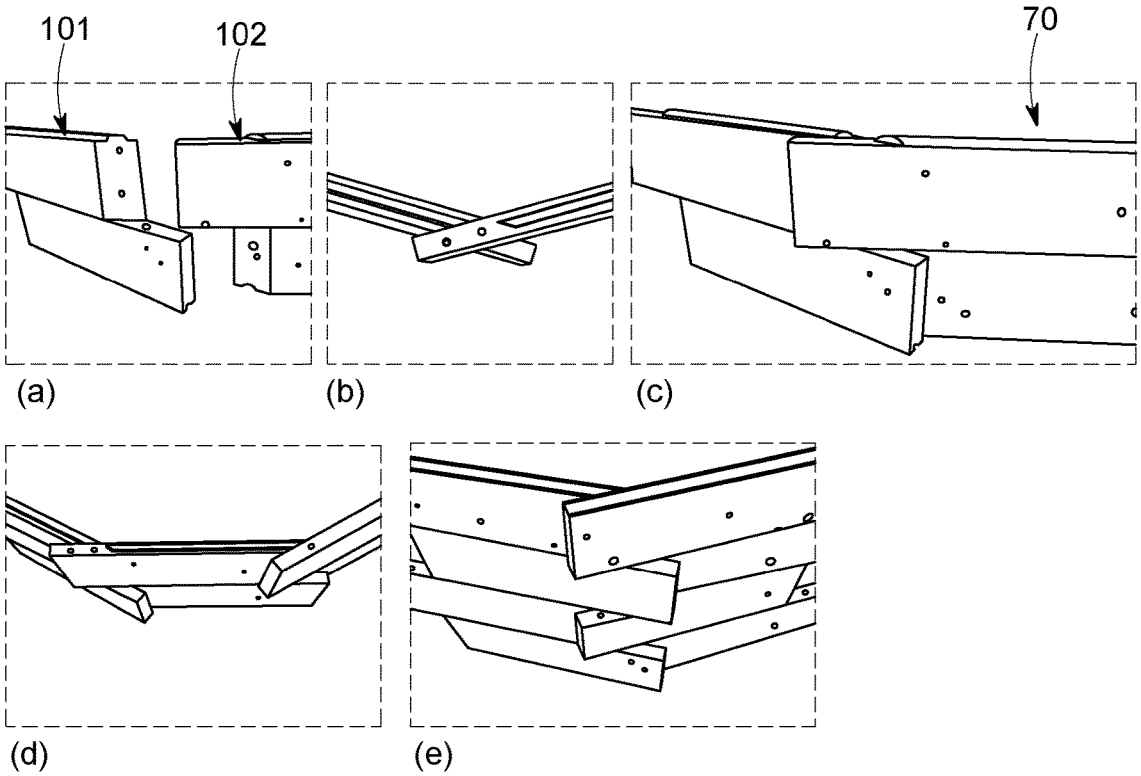
FIG. 6 shows images upon assembling the wall members according to the present invention.

FIG. 6 shows images regarding an assembling example of the wall members according to the present invention, and FIG. 6(*a*) shows a status wherein the respective contacting faces are arranged closely for combining with the wall members 102. FIG. 6(*b*) shows an image of a combination portion in a plan view wherein the wall member 101 and the wall member 102 are combined with each other. FIG. 6(*c*) is a perspective view of the status of FIG. 6(*b*).

FIG. 6(*d*) shows an image of a status wherein a further additional wall member is combined for three faces to the status of FIG. 6(*b*) and FIG. 6(*c*). FIG. 6(*e*) shows a status wherein a further stage of wall member is stacked upwardly to the status of FIG. 6(*b*) and FIG. 6(*c*).

Combination Portion 70

The combination portion 70 is composed to be a combination of the first wall member 101 and the second wall member 102. With respect to the wall member 101 and the wall member 102 shown in FIG. 6(*a*), one of two wall members used adjacently to these wall members 101, 102 is called as a first wall member to be combined with the wall member 101 (See, the left side of FIG. 6(*a*).). The other of the two wall members is called as a second wall member to be combined with the wall member 102 (See, the right side of FIG. 6(*a*).). In this way, the called second wall member (the wall member 102) is arranged at the side of the second side face of the called first wall member (the wall member 101).

In the combination portion 70, the rear face of the lower member of the wall member 101 contacts with the first side face of the lower member of the wall member 102. And, the rear face of the upper member of the wall member 102 contacts with the second surface of the upper member of the wall member 101. In this relationship, since the first angle θ1 and the second angle θ2 are designed to be 30 degrees, the wall member 101 and the wall member 102 are arranged to have a tilted angle of 30 degrees in a plan view. Repeatedly arranging the wall members constituting the combination portion according to the design enables to form one stage of the wall construction portion. Furthermore, repeatedly stacking the stage in a vertical direction enables to provide a plurality of stages of wall construction portion. In this way, the wall construction portion includes repeated portions each of which is the above-mentioned combination portion to form the wall portion of the architectural structure.

Figure 7:
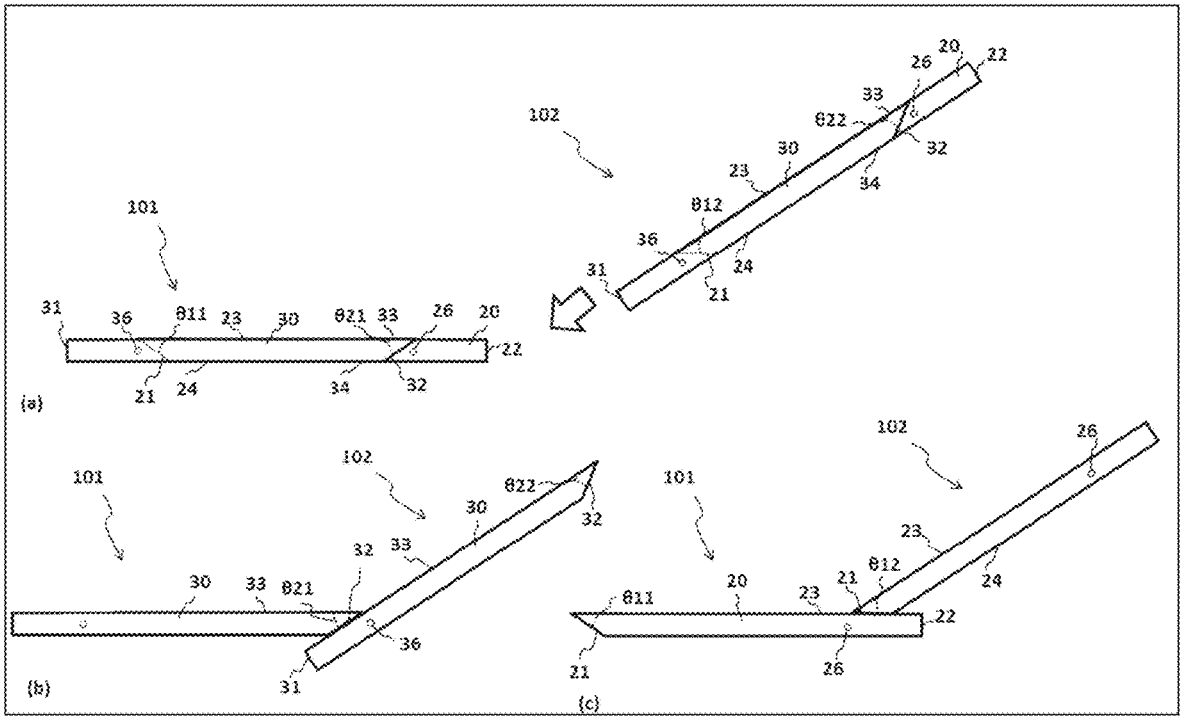
FIG. 7 shows an outline for explaining arrangement upon combining the wall members according to the present invention.

FIG. 7 shows an outline for explaining arrangement upon combining the wall members according to the present invention. FIG. 7(*a*) shows a moving direction wherein the first wall member 101 and the second wall member 102 are arranged to be combined with each other. FIG. 7(*b*) and FIG. 7(*c*) shows statuses wherein the respective wall members contacts to be combined with each other. FIG. 7(*b*) shows a contact status of the respective upper member 30 of the first wall member 101 and the second wall member 102, and FIG. 7(*c*) shows a contact status of the respective lower member 20 of the same. These figures correspond to FIG. 6(*a*) to FIG. 6(*c*). The first wall member 101 and the second wall member 102 have a structure corresponding to the wall member 10 shown in FIG. 1 to FIG. 3.

With respect to the first wall member 101, the first angle θ1 of is called as the first angle θ11 and the second angle θ2 is called as the second angle θ21 and with respect to the second wall member 102, the first angle θ1 of is called as the first angle θ12 and the second angle θ2 is called as the second angle θ22. Regarding this combination it is preferable that the second angle θ12 of the first wall member 101 and the first angle θ12 of the second wall member 102 is substantially identical. Herein, the respective angle is set up to be about 30 degrees.

As shown in FIG. 7(*b*), with respect to the upper member 30, the second side face 32 of the first wall member 101 contacts with the rear face 33 of the second wall member 102. And, as shown in FIG. 7(*c*), with respect to the lower member, the rear face 23 of the first wall member 101 contacts with the first side face 21 of the second wall member 102. That is, the connecting direction is reversed among the upper and lower members. Furthermore, inserting an axial member (not shown) inserted through the hole 26 of the lower portion 20 of the first wall member 101 further into the hole 36 of the upper member 20 of the second wall member 101 enables to align with each other.

According to this arrangement, rear faces of the respective members are located at the side of inner surfaces of the wall of the architectural structure. Herein, since both of the first angle θ12 and the second angle θ21 are 30 degrees, the respective members are in a tilted status in a plane view, and an angle between two of the inner surfaces is about 150 degrees. This angle is similar to interior angles of a regular dodecagon. Utilizing the wall construction portion wherein the combination is repeated to enable to build an architectural structure in a shape of a regular dodecagon in a plane view. This arrangement also provides a positional relationship wherein the upper member 30 of the second wall member 102 is stacked on the lower member 20 of the first wall member 101. Repeating this arrangement causes to the adjacent wall members vertically contact in a different direction to support with each other in a circumferential direction. It can be expected that excellent strength against load from various directions and high stability is achieved.

Door Side Wall Member

Figure 8:
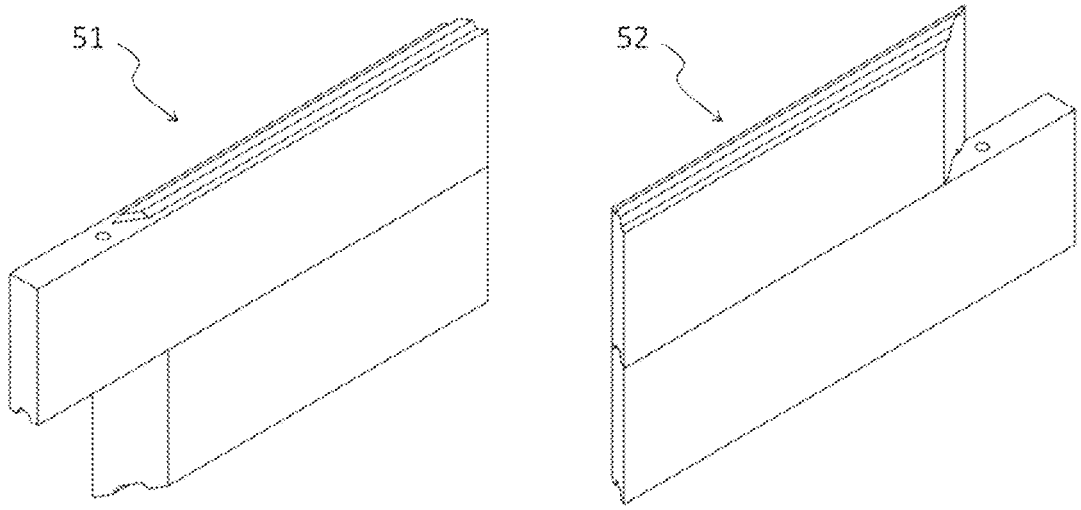
FIG. 8 shows an outline with respect to door side wall members available for the architectural structure according to the present invention.

FIG. 8 shows an outline with respect to the door side wall members 51, 52 available for the architectural structure according to the present invention. Normally a door is provided with at least one side of the architectural structure. The side provided with the door is linearly formed according to both ends of the door. In this context, wall members are arranged perimetrically, and the linearly formed door side wall members 51, 52 can be used for a part to be the side contacting with the door without process of combining wall members. An opposing part to the door of the door side wall members 51, 52 may be formed in a shape that corresponds to the upper member and the lower member of the wall member, the first side face, and the second side face, each of which contacts with the opposing part.

Sill Member 61, 62, 63

Figure 9:
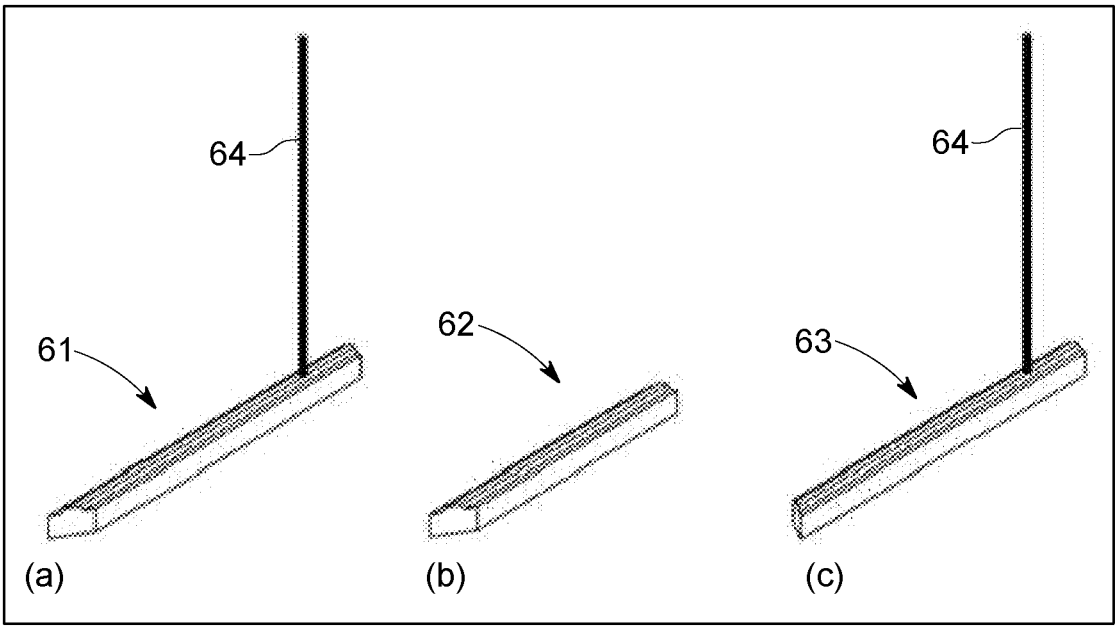
FIG. 9 shows an outline with respect to sill members available for the architectural structure according to the present invention.

FIG. 9 shows an outline with respect to sill members available for the architectural structure according to the present invention. The wall members according to the present invention may be used for constructing the lowest stage. Alternatively, special members other than the wall members according to the present invention may be used for constructing the sill. FIG. 9 shows an example of the sill member whose shape is other than that of the wall member. It is sufficient that the lower member of the wall member can be arranged on the sill member. For example, a fitting portion in a shape corresponding to the lower member may be provided with the sill member in a manner such that the fitting portion is fitted there-with so as to extend the lower member in a vertical direction. Alternatively, the sill member may have a shape corresponding to an upper member of another wall member to be fitted with the lower member. The wall members can be designed according to a similar idea referring to the example disclosed in FIG. 8 or the like. In the example of FIG. 9, in addition to the examples shown in FIG. 1 to FIG. 7 or the like, a corresponding recess (See, FIG. 4.) of the projection 35 for fitting with the recess 25 of the lower member 20 is provided based on the processed one for extending the lower member 20 of the wall member 10.

Example of Assembling Process

Figure 10:
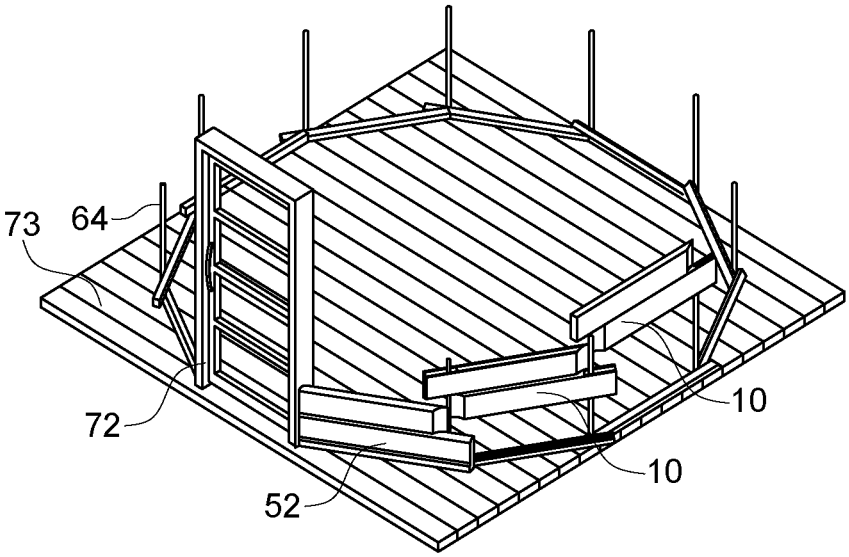
FIG. 10 shows a flow upon constructing an architectural structure according to the present invention.

FIG. 10 shows a flow upon constructing an architectural structure according to the present invention. Herein, construction is made so as to form a regular dodecagon including the door 72 on the floor portion 73 in a plan view. First of all, the sill portion in the regular dodecagon and the door 72 are provided. The axial member 64 is provided with the sill portion. Next, the door side wall member 52 adjacent to the door 72 is disposed on an upper stage of the sill portion, and the wall members 10 are stacked up in turn anticlockwisely, while inserting the axial member 64 into the hole of the wall member 10 to dispose thereof.

Architectural Example of Wall Construction Portion

Figure 11:
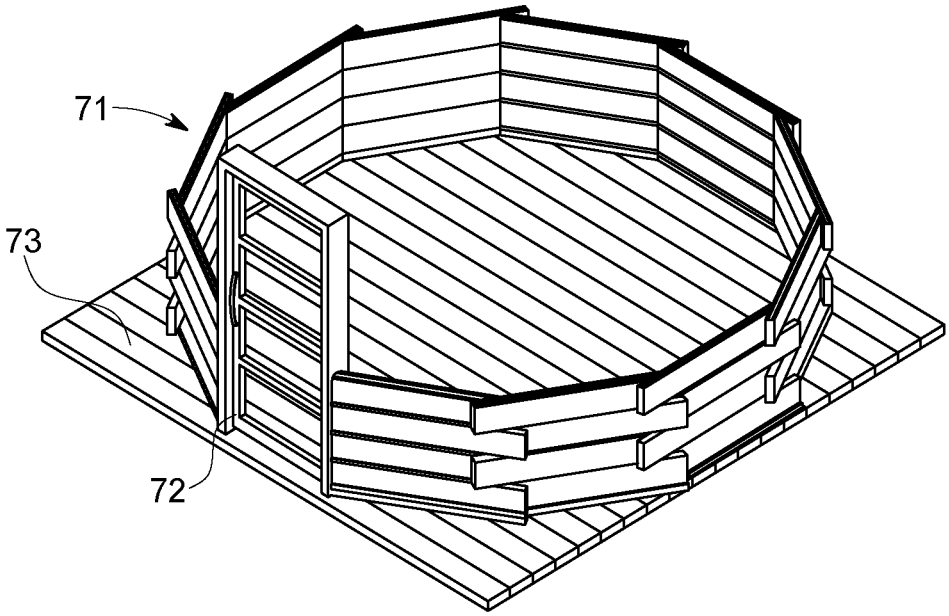
FIG. 11 shows a flow upon constructing an architectural structure according to the present invention.

FIG. 11 shows a flow upon constructing an architectural structure according to the present invention. This is a state wherein the two stages of wall members have been assembled as shown in FIG. 10, and then the wall construction portion 71 constructed by means of the wall members according to the present invention is provided therewith.

Architectural Example of Architectural Structure

Figure 12:
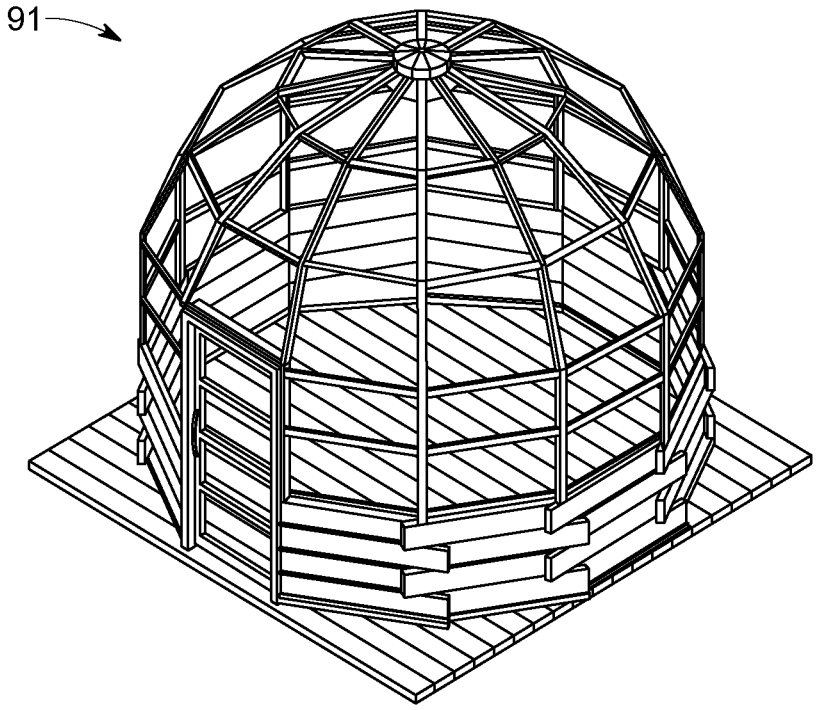
FIG. 12 shows an example of an architectural structure according to the present invention.

FIG. 12 shows an example of an architectural structure according to the present invention. After having constructed the wall construction portion 71, and then columns and transparent panels are built on the upper stage of the wall construction portion 71 to form the architectural structure 91 in a shape like a dome. The respective members in an easily handled size are assembled to form the architectural structure. Since the wall members are used for the sill portion, the architectural structure is excellent in stability.

Architectural Example of Architectural Structure

Figure 13:
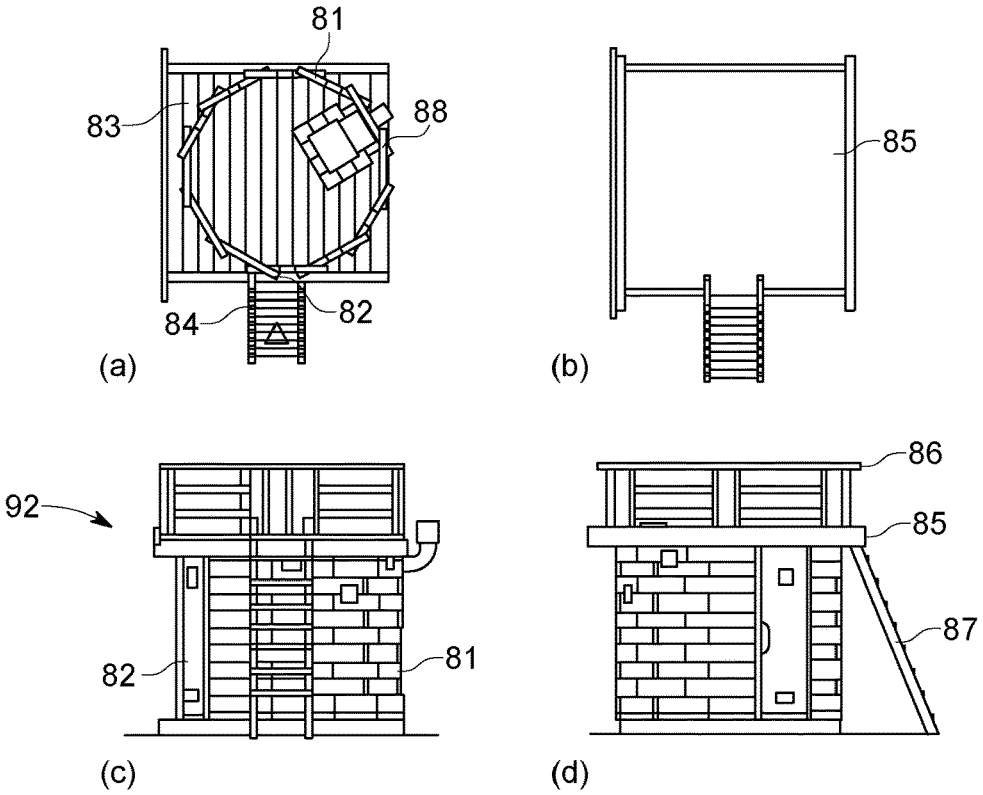
FIG. 13 shows another example of an architectural structure according to the present invention.
Figure 14:
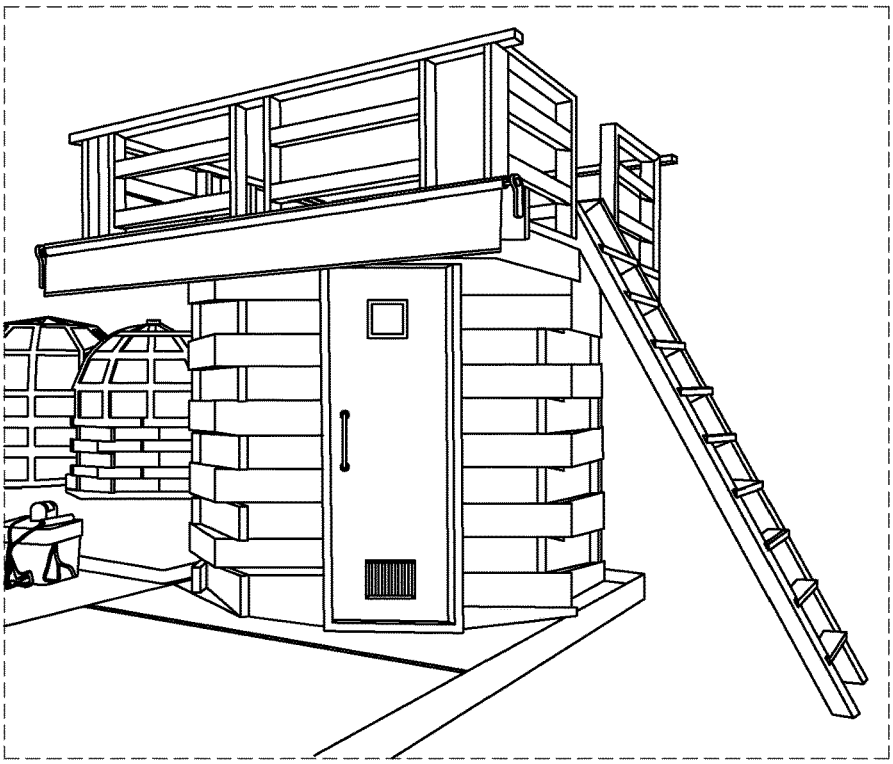
FIG. 14 shows the other example of an architectural structure according to the present invention.

FIG. 13 shows another example of an architectural structure according to the present invention. FIG. 14 shows an image of the other example of an architectural structure according to the present invention, and a manufacturing example of the shape shown in FIG. 13. FIG. 13(*a*) shows a sectional outline in a plan view, FIG. 13(*b*) shows an outline in a plan view, FIG. 13(*c*) shows an outline in a side view, and FIG. 13(*d*) shows an outline in a side view from a different direction. The architectural structure 92 uses the wall construction portion wherein the five stages of the wall members corresponding to FIG. 11 are stacked upwardly. The wall construction portion is used, and furthermore, the wall 81, and the door 82, the floor 83, the staircase 84, and the ceiling 85 are included therein. The wall construction has a shape of a regular dodecagon in a plan view, and looks like a cylindrical hut with a long body. And, the handrails 86 are provided with the ceiling, and the ladder 87 is provided so as to enable to go up to the ceiling. It is also possible to use the architectural structure 92 as a sauna while the sauna equipment 88 or the like is provided with the interior thereof.

INDUSTRIAL APPLICABILITY

The present invention involves industrial applicability since it can be utilized for architectural structures.

BRIEF DESCRIPTION OF SYMBOLS

10 wall member
20 lower member

21, 31 first side face
22, 32 second side face
23, 33 rear face
24, 34 front face
25 recess
26, 36 hole
30 upper member
35 projection
4 combination member
51, 52 door side wall member
61, 62, 63 sill member
64 axial member
70 combination portion
71 wall construction portion
72, 82 door
73, 83 floor
81 wall
84 staircase
85 ceiling
86 handrail
87 ladder
88 sauna equipment
91, 92 architectural structure

What is claimed is:

1. An architectural structure to be constructed using a plurality of wall members, each wall member comprising:

a lower member in a shape of a plate including a first rear face, a first side face, and a first acute angle formed between the first rear face and the first side face;

an upper member in a shape of a plate configured to be combined with the lower member, the upper member including a second rear face;

a second side face disposed to be opposed to the first side face of the lower member; and a second acute angle formed between the second rear face and the second side face, wherein the architectural structure comprises a wall including a combined portion formed by combining two adjacent wall members, one being a first wall member and the other being a second wall member, such that:

the first rear face of the lower member of the first wall member contacts with the first side face of the lower member of the second wall member at a side of the second side face of the first wall member;

the second side face of the upper member of the first wall member contacts with the second rear face of the second wall member; and the wall includes a wall construction portion wherein the combined portion is repeatedly arranged, and wherein the architectural structure comprises:

a polygonal arrangement of the wall members in a plan view;

an acute-angled end portion of the first wall member abutting a portion of the second wall member that is offset inward from an end of the second wall member;

an acute-angled end portion of the second wall member abutting a portion of another adjacent wall member that is offset inward from an end of the adjacent wall member; and an end portion of each wall member, opposite to the acute-angled end portion, extending outwardly beyond a perimeter of the architectural structure.

2. The architectural structure as defined in claim 1, wherein:

each of the plurality of wall members includes:

a fitting portion having a shape enabling a lower face of the lower member and an upper face of the upper member to be fitted with each other; and a hole through which an axial member is arranged in a vertical direction;

wherein the architectural structure comprises at least two stages of the wall construction portions are provided in the vertical direction by:

inserting a long axial member into the hole of each of the plurality of wall members; and fitting the fitting portion of the upper member arranged in the vertical direction with the lower wall member and a corresponding fitting portion of the lower member arranged with the upper wall member.

3. An architectural structure to be constructed using a plurality of wall members, each wall member comprising:

a lower member in a shape of a plate including a first rear face, a first side face, and a first acute angle formed between the first rear face and the first side face;

an upper member in a shape of a plate configured to be combined with the lower member, the upper member including a second rear face;

a second side face disposed to be opposed to the first side face of the lower member; and a second acute angle formed between the second rear face and the second side face, wherein the architectural structure comprises a wall including a combined portion formed by combining two adjacent wall members, one being a first wall member and the other being a second wall member, such that:

the first rear face of the lower member of the first wall member contacts with the first side face of the lower member of the second wall member at a side of the second side face of the first wall member;

the second side face of the upper member of the first wall member contacts with the second rear face of the second wall member; and the wall includes a wall construction portion wherein the combined portion is repeatedly arranged, and wherein the architectural structure comprises:

an acute-angled end portion of the first wall member abutting a portion of the second wall member that is offset inward from an end of the second wall member;

an acute-angled end portion of the second wall member abutting a portion of another adjacent wall member that is offset inward from an end of said adjacent wall member; and an end portion of each wall member, opposite to the acute-angled end portion, extending outwardly beyond a perimeter of the architectural structure.

4. The wall member as defined in claim 3, further comprising at least one of:

a fitting portion enabling a lower face of the lower member and an upper face of the upper member to be fitted with each other; and a hole through which an axial member is arranged in a vertical direction.

* * * * *